US011173365B2

(12) United States Patent
Kinnunen et al.

(10) Patent No.: US 11,173,365 B2
(45) Date of Patent: Nov. 16, 2021

(54) CLIMBING WALL ASSEMBLY

(71) Applicant: KIDTEK OY, Tampere (FI)

(72) Inventors: Jouni Kinnunen, Tampere (FI); Katri Kinnunen, Tampere (FI)

(73) Assignee: KIDTEK OY, Tampere (FI)

( * ) Notice: Subject to any disclaimer, the term of this patent is extended or adjusted under 35 U.S.C. 154(b) by 137 days.

(21) Appl. No.: 16/484,591

(22) PCT Filed: Feb. 19, 2018

(86) PCT No.: PCT/FI2018/050118
§ 371 (c)(1),
(2) Date: Aug. 8, 2019

(87) PCT Pub. No.: WO2018/154177
PCT Pub. Date: Aug. 30, 2018

(65) Prior Publication Data

US 2021/0138329 A1 May 13, 2021

(30) Foreign Application Priority Data

Feb. 21, 2017 (FI) ..... 20175159

(51) Int. Cl.
*A63B 69/00* (2006.01)

(52) U.S. Cl.
CPC ..... *A63B 69/0048* (2013.01); *A63B 2209/08* (2013.01); *A63B 2209/10* (2013.01)

(58) Field of Classification Search
CPC ..... A63B 69/0048; A63B 2209/08; A63B 2209/10
See application file for complete search history.

(56) References Cited

U.S. PATENT DOCUMENTS

| | | | | |
|---|---|---|---|---|
| 3,399,746 | A | 9/1968 | Wood | |
| 3,833,090 | A | 9/1974 | Georgianna | |
| 2011/0319230 | A1* | 12/2011 | Brendle | A63B 69/0048 482/37 |
| 2019/0247714 | A1* | 8/2019 | Curry | A63B 69/0048 |
| 2020/0094102 | A1* | 3/2020 | McRann | A63B 23/1218 |

FOREIGN PATENT DOCUMENTS

| | | |
|---|---|---|
| CN | 1068404 | 1/1993 |
| FR | 2517106 | 5/1983 |
| WO | 200068541 | 11/2000 |
| WO | 2010105113 | 9/2010 |

OTHER PUBLICATIONS

The International Search Report (ISR) for PCT/FI2018/050118 dated May 21, 2018, pp. 1-5.
Written Opinion of the International Searching Authority for PCT/FI2018/050118 dated May 21, 2018, pp. 1-7.

* cited by examiner

*Primary Examiner* — Jennifer Robertson
(74) *Attorney, Agent, or Firm* — McDonnell Boehnen Hulbert & Berghoff LLP

(57) ABSTRACT

A climbing wall assembly comprising at least one wall panel (2) arranged to provide at least a portion of a climbing wall (1), a number of hand hold structures (5) to be placed to the at least one wall panel (2) and a number of integrated fastening elements (3) arranged in the at least one wall panel (2) for receiving the hand hold structures (5) to be placed to the at least one wall panel (2).

15 Claims, 3 Drawing Sheets

CLIMBING WALL ASSEMBLY

CROSS-REFERENCE TO RELATED APPLICATION

This application is a U.S. national phase of International Application No. PCT/FI2018/050118, filed Feb. 19, 2018, which claims priority to Finland Patent Application No. 20175159, filed Feb. 21, 2017, both of which are incorporated by reference herein in their entirety.

FIELD OF THE INVENTION

The present invention relates to a climbing wall.

BACKGROUND OF THE INVENTION

FR-publication 2592588 A1 discloses a climbing wall of a prior art. The climbing wall of the FR-publication 2592588 A1 comprises hand holds that are fastened with bolts to wall panels in the climbing wall.

BRIEF DESCRIPTION OF THE INVENTION

An object of the present invention is to provide a novel climbing wall assembly.

The invention is characterized by the features of the independent claim.

The invention is based on the idea of having a number of integrated fastening elements arranged in the climbing wall, wherein the fastening elements are arranged to receive hand hold structures used for supporting hands and feet during climbing so as to arrange the hand hold structures in connection with the climbing wall in quick clamping manner.

When the climbing wall comprises a number of integrated fastening elements, i.e. fastening elements formed of or defined by the at least one wall panel of the climbing wall, no fastening elements that are separately attachable to the climbing wall are needed. This simplifies a manufacturing and an introduction of the climbing wall. Furthermore, the fastening elements in the climbing wall are implemented in such a way that they are able to receive and support the hand hold structures to be placed to the fastening elements in quick clamping manner without any need for separately attachable fasteners.

Some embodiments of the invention are disclosed in the dependent claims.

BRIEF DESCRIPTION OF THE DRAWINGS

In the following the invention will be described in greater detail by means of preferred embodiments with reference to the accompanying drawings, in which.

For the sake of clarity, the figures show some embodiments of the invention in a simplified manner. Like reference numerals identify like elements in the figures.

DETAILED DESCRIPTION OF THE INVENTION

Figure 1:
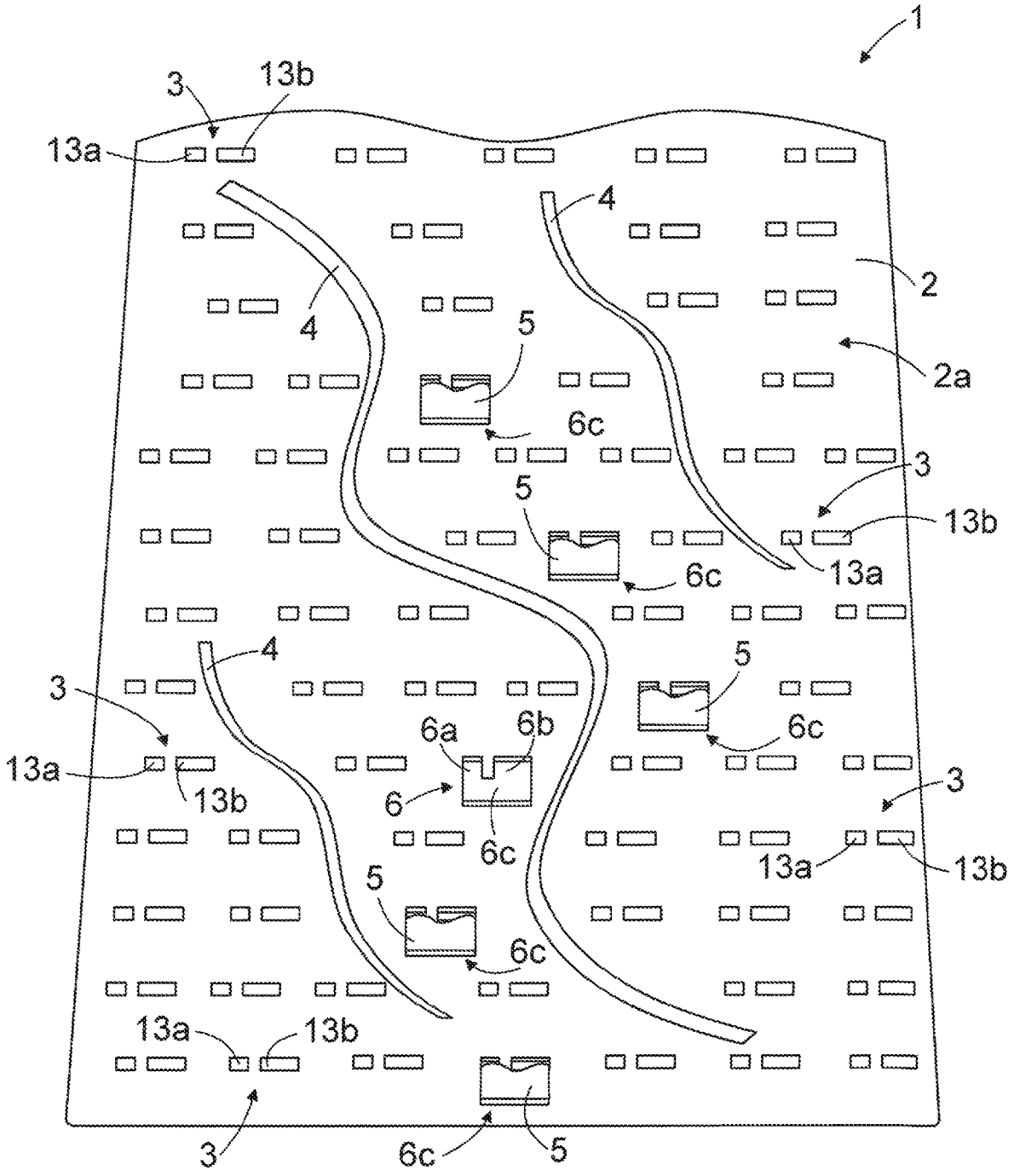
FIG. 1 shows schematically a front view of a climbing wall.
Figure 2:
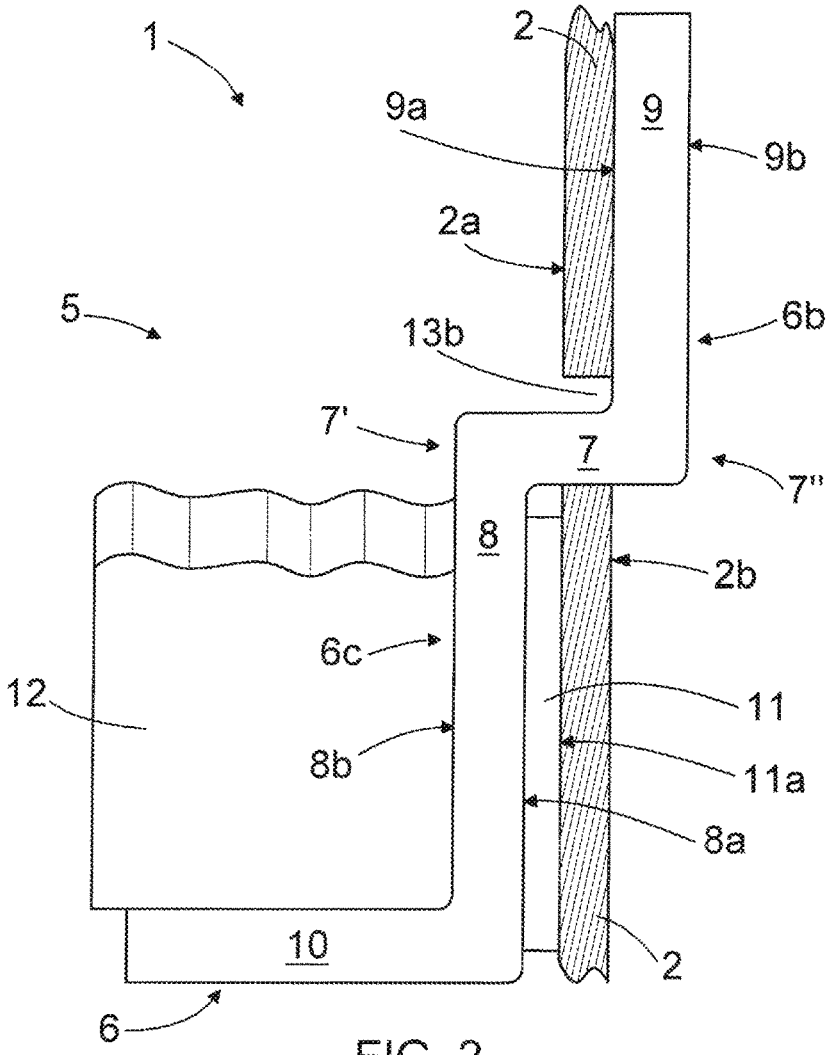
FIG. 2 shows schematically a side view of the climbing wall and a hand hold structure placed to the climbing wall.

FIG. 1 shows schematically a front view of a climbing wall 1. FIG. 2 shows schematically a side view of the climbing wall 1 and a hand hold structure 5 arranged to the climbing wall 1, wherein the wall panel 2 of the climbing wall 1 is shown in cross section. The hand hold structures 5 are intended to provide supports for hands and feet during climbing. For the sake of clarity, only few hand hold structures 5 are shown in FIG. 1.

The climbing wall 1 of FIG. 1 comprises a single wall panel 2. The climbing wall 1 may, however, comprise two or more wall panels 2 which are laid adjacent to each other and/or on top of each other for forming a single uniform climbing wall 1. When the climbing wall 1 comprises a plurality of wall panels 2, the wall panels 2 may be attached to each other and/or to a support construction, which may be a supporting frame or a wall of a building, for example, so as to provide the substantially uniform climbing wall 1.

The wall panel 2 comprises a front surface 2*a* which provides a side of a use of the wall panel 2, i.e. that side of the wall panel 2, where a route for climbing is provided. The wall panel 2 further comprises a back surface 2*b* which provides a side of the wall panel 2 to be directed towards the support construction where the wall panel 2 is supported to.

The wall panel 2 may be made of many different materials. According to an embodiment the wall panel 2 may be made of a sheet of metal, such as steel or aluminium, for example. According to a second embodiment the wall panel 2 may be made of plywood. According to a third embodiment the wall panel 2 may be for example a two-layer structure having a first layer on the front surface 2*a* side and a second layer on the back surface 2*b* side, whereby the first layer may be made of a metal sheet and the second layer may be made of a plywood sheet attached to the metal sheet, for example.

The wall panel 2 comprises a number of integrated fastening elements 3 arranged in the wall panel 2 for receiving the hand hold structures 5 to be placed to the wall panel 2. With the integrated fastening elements it is meant fastening elements that are formed of or defined by the wall panel 2.

In the embodiment of FIGS. 1 and 2 the fastening element 3 comprises two closely spaced adjacent apertures 13*a*, 13*b*, i.e. a first aperture 13*a* and a second aperture 13*b*, arranged through the wall panel 2. The apertures 13*a*, 13*b* thus extend from the front surface 2*a* of the wall panel 2 up to the back surface 2*b* of the wall panel 2.

The fastening element 3 in FIGS. 1 and 2 thus comprises an aperture pattern formed of two closely spaced adjacent apertures 13*a*, 13*b*, i.e. the first aperture 13*a* and the second aperture 13*b*, wherein a width of the left hand side first aperture 13*a* is dimensioned to be smaller than a width of the right hand side second aperture 13*b*. A height of the apertures 13*a*, 13*b* is preferably 5 mm or less so that fingers or toes of even small children will not stick in the apertures 13*a*, 13*b*. Generally the aperture pattern may comprise two or more substantially closely spaced apertures. An aperture pattern formed of for example two closely spaced adjacent but substantially narrow apertures provides a more stable locking of the hand hold structure 5 to the wall panel 2 than a single but substantially wide aperture. Generally the manufacturing of the fastening elements as apertures is simple and cost-effective.

The aperture pattern of the apertures 13*a*, 13*b* provide one type of non-protruding fastening element 3 on the side of the front surface 2*a* of the wall panel 2 for receiving at least part of the body element 6 of the hand hold structure 5 for arranging the hand hold structure 5 in connection with the wall panel 2, i.e. for bringing the hand hold structure 5 to be suspended by the wall panel 2. With the term non-protruding it is meant that the fastening element for receiving the hand hold structure 5 in connection with the wall panel 2 does not extend above a plane of the front surface 2*a* of the wall panel 2. The advantage of non-protruding fastening elements on the side of the front surface 2*a* of the wall panel 2 is that fastening elements 3 not being provided with the hand hold structures 5 do not cause any risk of injury. The aperture patterns of apertures 13*a*, 13*b* are arranged in various positions in the plane of the front surface 2*a* of the wall panel 2, i.e. at various heights in a height direction of the wall panel 2 and at various positions in a width direction of the wall panel 2.

In an alternative embodiment the fastening element may comprise at least one recess arranged in the wall panel, whereby at least part of the body element of the hand hold structure will be inserted into the at least one recess. The recess may for example have a varying cross sectional shape which may enable a form locking to take place between the fastening element comprising at least one recess and the body element of the hand hold structure to be inserted into the at least one recess. The at least one recess thus provides another type of non-protruding fastening element in the wall panel for receiving a body element of the hand hold structure for arranging the hand hold structure in connection with the wall panel, i.e. to be suspended by the wall panel.

In the embodiment of FIG. 1 the front surface 2*a* of the wall panel 2 comprises also grooves 4 engraved into the front surface 2*a* of the wall panel 2. A width of the groove 4 may vary in its direction of extension, as shown in FIG. 1. The grooves 4 provide one type of stiffener elements arranged to the wall panel 2 in order to increase a torsional effect against torsional forces appearing in the wall panel 2 during a climbing of a person. The stiffener elements may be arranged to the front surface 2*a* of the wall panel 2 and/or to the back surface 2*b* of the wall panel 2. The stiffener elements may also reduce the sound inducing tendency of the vibrating wall panel 2 made of thin planar metal sheet. Instead of grooves for example rigid strips or ribbons attached to at least one of the surface 2*a*, 2*b* of the wall panel 2 may be used as stiffener elements applied to the wall panel 2.

Further referring to FIGS. 1 and 2, the hand hold structure 5 comprises a body element 6 for placing the hand hold structure 5 to the wall panel 2, or in other words, for arranging the hand hold structure 5 in connection with the fastening element 3 in the wall panel 2. The body element 6 carries a weight of a climbing person and forwards it to the climbing wall 1. The hand hold structure 5 further comprises a holder element 11 arranged to the body element 6 for supporting the hand hold structure 5 firmly against the front surface 2*a* of the wall panel 2. The holder element 11 thus keeps or holds or bonds the hand hold structure 5 firmly against the front surface 2*a* of the wall panel 2. Furthermore the hand hold structure 5 comprises a hand hold element 12 arranged to the body element 6 for providing a support for a hand or a foot during climbing. The hand hold element 12 may for example be an arbitrary shaped piece made of plastic.

The body element 6 shown in FIGS. 1 and 2 comprises a hooked-like construction and has a first upwards extending hooked-like branch 6*a* to be inserted into the first aperture 13*a* of the fastening element 3, a second upwards extending hooked-like branch 6*b* to be inserted into the second aperture 13*b* of the fastening element 3 and a basic body 6*c* of the carrier element 6, i.e. the body element 6, therebetween, as shown in FIG. 1. Preferably the width of the second branch 6*b* of the body element 6 is dimensioned to be greater than the width of the first aperture 13*a*, whereby the hand hold structure 5 may be placed to the fastening element 3 in only one intended position, i.e. it is not possible to place the hand hold structure 5 to the wall panel 2 in an incorrect position.

The second branch 6*b* of the body element 6 comprises a horizontal part 7 to be positioned substantially horizontally through the aperture 13*b* in the wall panel 2 when the hand hold structure 5 is to be placed to the wall panel 2 or is to be arranged in connection with the wall panel 2. The first branch 6*a* of the body element 6 comprises a corresponding horizontal part too. The horizontal part 7 transfers the substantially vertical force generated by a weight of a person performing the climbing to the wall panel 2. The horizontal part 7 comprises a first end 7' which is arranged to remain on the side of the front surface 2*a* of the wall panel 2 when the hand hold structure 5 is arranged to the wall panel 2. Furthermore the first horizontal part 7 comprises a second end 7" which is arranged to remain on the side of the back surface 2*b* of the wall panel 2 when the hand hold structure 5 is arranged to the wall panel 2.

At the first end 7' of the first horizontal part 7 there is connected a substantially vertically downwards extending vertical part 8 that forms a part of the basic body 6*c* of the body element 6. The vertical part 8 has a first surface 8*a* to be laid towards the front surface 2*a* of the wall panel 2 below the aperture 13*a*, 13*b*, when the hand hold structure 5 is placed to the wall panel 2, and a second surface 8*b* against which the hand hold element 12 may be supported to. At the second end 7" of the horizontal part 7 there is connected a substantially vertically upwards extending vertical part 9 that forms a part of the second branch 6*b* of the body element 6. The first branch 6*a* of the body element 6 comprises a corresponding vertical part too. The vertical part 9 has a first surface 9*a* to be laid against the back surface 2*b* of the wall panel 2 above the aperture 3 and a second surface 9*b* facing away from the wall panel 2, when the hand hold structure 5 is placed to the fastening element 3. The first surface 9*a* of the vertical part 9 provides a support surface through which the body element 6 is supported to the back surface 2*b* of the wall panel 2.

At the opposite end of the first vertical part 8 relative to the end connected to the horizontal part 7 there is connected a horizontal part 10 that forms a part of the basic body 6*c* of the body element 6 and is arranged to extend away from the first surface 2*a* of the wall panel 2. The horizontal part 10 provides, together with the second surface 8*b* of the vertical part 8 a support for the hand hold element 12.

The horizontal part 7, the vertical part 8 and the vertical part 9 together form a hooked construction providing a quick clamping for the hand hold structure 5 so that the hand hold structure 5 can be placed or installed to the fastening element 3 in the wall panel 2 and detached from the fastening element 3 in the wall panel 2 just by hands without using any tools. This means, that there are no separate fasteners, such as screws or bolts, or any internal locking lever. When the hand hold structure 5 is placed to the fastening element 3 in the wall panel 2, the hand hold structure 5 is turned about 90 degrees to the right relative to the position shown in FIG. 2, whereby the vertical part 9 in the first 6*a* and second 6*b* branches of the body element 6 will be in a substantially horizontal position, whereby they can be pushed through the apertures 13*a*, 13*b*. After the vertical parts 9 have been pushed through the aperture 13*a*, 13*b* from the side of the front surface 2*a* of the wall panel 2 towards the back side of the back surface 2*b* of the wall panel 2 so that they at least partly extend outside the apertures 13*a*, 13*b* at the back surface 2*b* side of the wall panel 2, the hand hold structure 5 is turned about 90 degrees back to the position shown in FIG. 2. The placing of the hand hold structure 5 to the wall panel 2 and detaching from the wall panel 2 can thus be done just by hands with a quick clamping manner when the placement of the hand hold structures 5 are varied in the climbing wall 1. The dimensions of the horizontal parts 7, the vertical parts 9 and the apertures 13*a*, 13*b* are arranged relative to each other in such a way that the turning of the hand hold structure 5 as disclosed above is possible.

In the position of the hand hold structure 5 as disclosed in FIG. 2 and explained above the vertical part 9 prevents the hand hold structure 5 to become unintentionally loosen from the wall panel 2. The horizontal part 7 transfers the substantially vertical force generated by the weight of the climbing person to the structure of the wall panel 2, whereby the load due to the climbing person is directed to be parallel to the direction wherein the hand hold structure 5 is supported to the wall panel 2, which prevents an unintentional opening of the placing of the hand hold structure 5 during climbing.

As already shortly disclosed above, the hand hold structure 5 comprises the holder element 11, which is intended to fasten or support the hand hold structure 5 to the front surface 2*a* of the wall panel 2 substantially absence of any play or clearance so that the hand hold structure 5 is supported firmly against to the front surface 2*a* of the wall panel 2. This means that during climbing a hand or a foot may be supported to the hand hold element 12 of the hand hold structure 5 so that the hand hold structure 5 does not move or vibrate.

In the embodiment of FIG. 2 the holder element 11 is arranged at to the first surface 8*a* of the vertical part 8 of the body element 6, whereby the holder element 11 is placed between the vertical part 8 of the body element 6 and the front surface 2*a* of the wall panel 2. In an alternative embodiment the holder element 11 may be at least partly embedded into the first surface 8*a* of the vertical part 8 of the body element 6. The surface 11*a* of the holder element 11 facing towards the front surface 2*a* of the wall panel 2 provides a support surface through which the hand hold structure 5 is supported to the front surface 2*a* of the panel wall 2 at the vertical part 8 of the body element 6.

If the wall panel 2 or the front surface 2*a* thereof is of metal, the holder element 11 may be a magnetic or a group of magnets, whereby a magnetic force is generated between the hand hold structure 5 and the wall panel 2. At an outer surface of the magnet there may also be a piece of rubber to prevent two metallic surfaces to contact straight to each other. Alternatively the holder element 11 may be a suction pad, whereby a force provided by underpressure prevailing in the suction pad maintains the hand hold structure 5 against the front surface 2*a* of the wall panel 2. As the holder element 11 it may also be used sticker tape material comprising hooks and loops for creating a mechanical bond between the hand hold structure 5 and the front surface 2*a* of the wall panel 2. According to a further alternative embodiment the holder element 11 may be an element made of soft adhesive material whereby the holder element 11 and the hand hold structure 5 together it become adhered to the front surface 2*a* of the wall panel 2. In this embodiment the supporting effect is based on an increase of friction between the hand hold structure and the wall panel 2.

The climbing wall assembly as disclosed provides a climbing wall wherein a placing of the hand hold structures 5 may be easily varied for providing various routes for climbing. The placing of the hand hold structures 5 may be easily varied because of the quick clamping of the hand hold structures 5 to the wall panel 2, whereby no tools are needed to fasten the hand hold structures 5 to the wall panel 2 or the detach the hand hold structures 5 from the wall panel 2. Yet the support of the hand hold structures to the wall panel 2 is firm.

In the description and Figures above the fastening elements 3 were formed especially of aperture patterns of at least two substantially closely spaced apertures. Alternatively the fastening element in the wall panel may also be a single aperture configured to receive at least part of the body element of the hand hold structure. With a suitable shape of the single aperture and a corresponding shape of the body element of the hand hold structure it may be ensured that the hand hold structure may be placed to the fastening element only in one intended position.

Figure 3:
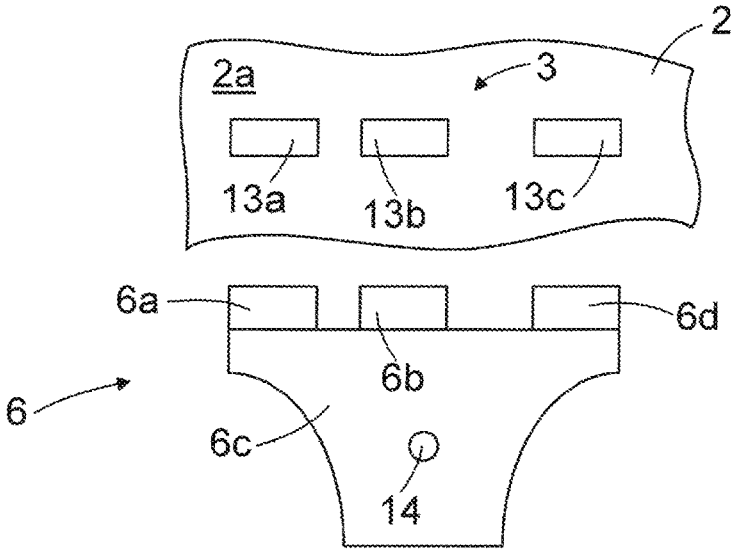
FIG. 3 shows a schematic front view of an embodiment of a fastening structure and a body of a hand hold structure.

FIG. 3 shows a schematic front view of an alternative embodiment of a fastening structure 3 and a body 6 of a hand hold structure 5. The wall panel 2 comprises an integrated fastening element 3 arranged in the wall panel 2 for receiving the hand hold structure 5 to be placed to the wall panel 2. The fastening element 3 of FIG. 3 is an aperture pattern comprising three closely spaced adjacent apertures 13*a*, 13*b*, 13*c*, i.e. a first aperture 13*a*, a second aperture 13*b* and a third aperture 13*c*, arranged through the wall panel 2. The apertures 13*a*, 13*b*, 13*c* are of the same width but the distance between the first aperture 13*a* and the second aperture 13*b* is only about half of the distance between the second aperture 13*b* and the third aperture 13*c*. In other words, the placement of the apertures 13*a*, 13*b* 13*c* is asymmetrical relative to a middle point of the aperture pattern of FIG. 3.

FIG. 3 further shows a schematic front view of a structure of a body element 6 of a hand hold structure 5 suitable to be used with the fastening element 3 of FIG. 3. The body element 6 comprises a basic body 6*c* and a first 6*a*, a second 6*b* and a third 6*d* upwards extending hooked-like branches to be inserted into the first aperture 3*a*, the second aperture 3*b* and the third aperture 3*c*. The general construction of the hooked-like branches 6*a*, 6*b*, 6*d* may be substantially similar to that disclosed in FIG. 2, for example. With the asymmetrical placement of the apertures 13*a*, 13*b*, 13*c* in the wall panel 2 and the correspondingly asymmetrical placement of the hooked-like branches 6*a*, 6*b*, 6*d* in the basic body 6*c* of the body element 6 of the hand hold structure 5 it may be ensured that the hand hold structure 5 is to be placed to the wall panel 2 only in one intended position.

The body element 6 of the hand hold structure 5 does not comprise any horizontal part 10 but it comprises an opening 14 arranged through the basic body 6*c* of the body element 6, whereby the hand hold element 12 may be fastened to the body element 6 for example with a screw or a bolt extending through the opening 14.

According to an embodiment the hand hold element 12 may be a uniform part with the body element 6 of the hand hold structure 5, whereby the hand hold element 12 and the body element 6 of the hand hold structure 5 may be manufactured as a single uniform part.

In the embodiment of FIGS. 1 and 2 the aperture pattern has two horizontally adjacent apertures 13*a*, 13*b*, and in the embodiment of FIG. 3 the aperture pattern has three horizontally adjacent apertures 13*a*, 13*b*, 13*c*. Alternatively, apertures in an aperture pattern may be arranged to be adjacent relative to each other in a vertical direction, or the apertures may be arranged to be adjacent relative to each other along a line extending between horizontal and vertical directions. Generally, the apertures in the aperture pattern may be arranged to be horizontally and/or vertically different positions relative to each other, whereby the hooked-like branches 6*a*, 6*b*, 6*d* in the body element 6 of the hand hold structure 5 are arranged or placed correspondingly.

According to an embodiment a lower edge of the climbing wall 1 may rest on a floor and an upper part of the climbing wall 1 may be supported to a fixed wall with support means which enable an angle of inclination of the climbing wall to be varied. According to another embodiment the climbing wall 1 is supported to a fixed wall with a support frame fixedly fastened to the wall or with fasteners that allow a gap to be left between a background of the climbing wall 1 and the wall of the building. According to a further embodiment a freestanding support frame may be used to support the climbing wall to a desired position of use. According to an embodiment the climbing wall may be attached to the wall of the building, or to some other suitable supporting structure, with a hinge that allows the angle of the inclination of the climbing wall to be varied by moving a bottom part of the climbing wall towards the wall of the building or away from it.

Figure 4:
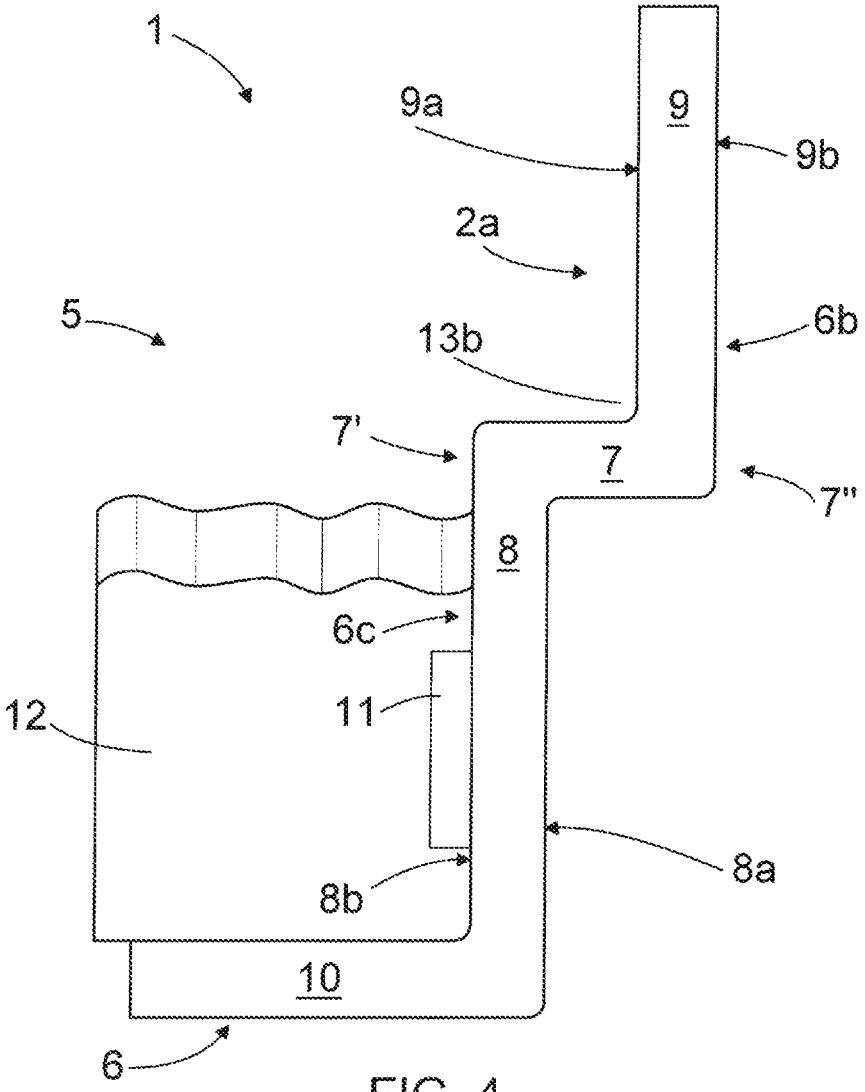
FIG. 4 shows schematically a side view of another hand hold structure.

FIG. 4 shows schematically a view of another hand hold structure 5 in cross section. For the sake of clarity, no cross sectional lineation is disclosed in FIG. 4. The hand hold structure 5 of FIG. 4 comprises the same parts as the hand hold structure 5 of FIG. 2, but in the embodiment of FIG. 4 the holder element 11 is composed of at least one magnet that is/are embedded into the hand hold element 12. The hand hold element 12 may for example be made of plastic. The holder element 11 is placed in the hand hold element 12 substantially close to the basic body 6*c* of the body element 6 so that the magnetic force generating between the holder element 11 and the front surface 2*a* of the wall panel 2 through the basic body 6*c* of the body element 6 is strong enough to support the hand hold structure 5 firmly against to the front surface 2*a* of the wall panel 2. According to an embodiment of the hand hold structure 5 the holder element 11 composed of at least one magnet may also be arranged to partly surround the basic body 6*c* of the body element 6 at side edges of the basic body 6*c* of the body element 6.

It will be obvious to a person skilled in the art that, as the technology advances, the inventive concept can be implemented in various ways. The invention and its embodiments are not limited to the examples described above but may vary within the scope of the claims.

The invention claimed is:

1. A climbing wall assembly comprising:

at least one wall panel arranged to provide at least a portion of a climbing wall, a number of hand hold structures to be placed to the at least one wall panel, a number of integrated fastening elements arranged in the at least one wall panel for receiving the hand hold structures to be placed to the at least one wall panel, wherein the hand hold structure comprises a body element for arranging the hand hold structure in connection to the at least one fastening element in the wall panel with quick clamping for arranging the hand hold structure to be suspended by the at least one wall panel without separately attachable fasteners, a hand hold element arranged in connection with the body element, a holder element arranged to the body element or embedded into the hand hold element for supporting the hand hold structure with substantially absence of play against a front surface of the at least one wall panel, and the holder element comprises at least one of a magnet, a suction pad, a sticker tape material comprising hooks and loops for creating a mechanical bond and an element made of soft adhesive material.

2. A climbing wall assembly as claimed in claim 1, wherein the body element of the hand hold structure comprises a hooked construction at least part of which is to be arranged in connection with the at least one fastening element in the at least one wall panel.

3. A climbing wall assembly as claimed in claim 2, wherein at least part of the hooked construction of the body element of the hand hold structure is to be arranged through at least one aperture in the at least one wall panel from the side of the front surface of the wall panel up to the opposite side of the wall panel.

4. A climbing wall assembly as claimed in claim 2, wherein the hooked construction of the body element comprises a downwards extending vertical part having a surface to be laid towards the front surface of the wall panel next to at least one aperture in the wall panel and an upwards extending vertical part having a surface to be laid towards the back surface of the wall panel on the other side of the same at least one aperture in the wall panel relative to the vertical part of the body element to be laid towards the front surface of the wall panel when the hand hold structure is placed to the at least one wall panel in the climbing wall.

5. A climbing wall assembly as claimed in claim 4, wherein the holder element is arranged at the surface of the vertical part of the hooked construction of the body element facing towards the front surface of the wall panel next to the at least one aperture.

6. A climbing wall assembly as claimed in claim 1, wherein the at least one wall panel comprises at least one stiffener element arranged to the at least one surface of the wall panel in order to increase a torsional strength of the wall panel.

7. A climbing wall assembly as claimed in claim 6, wherein the at least one stiffener element comprises at least one groove engraved in the front surface of the wall panel.

8. A climbing wall assembly as claimed in claim 1, wherein the holder element is arranged in the body element.

9. A climbing wall assembly as claimed in claim 1, wherein the holder element is composed of at least one magnet which is embedded into the hand hold element.

10. A hand hold structure to be placed to at least one wall panel of a climbing wall, comprising:

a body element for arranging the hand hold structure in connection to at least one fastening element in the wall panel with quick clamping, for arranging the hand hold structure to be suspended by the at least one wall panel without separately attachable fasteners, a hand hold element arranged in connection with the body element, a holder element arranged to the body element or embedded into the hand hold element for supporting the hand hold structure with substantially absence of play against a front surface of the at least one wall panel, and the holder element comprises at least one of a magnet, a suction pad, a sticker tape material comprising hooks and loops for creating a mechanical bond and an element made of soft adhesive material.

11. A hand hold structure according to claim 10, wherein the body element of the hand hold structure comprises a hooked construction, at least part of which is to be arranged in connection with the at least one fastening element in the at least one wall panel; and at least part of the hooked construction of the body element of the hand hold structure is to be arranged through at least one aperture in the at least one wall panel from the side of the front surface of the wall panel up to the opposite side of the wall panel.

12. A hand hold structure as claimed in claim 10, wherein the hooked construction of the body element comprises a downwards extending vertical part having a surface to be laid towards the front surface of the wall panel next to at least one aperture in the wall panel and an upwards extending vertical part having a surface to be laid towards the back surface of the wall panel on the other side of the same at least one aperture in the wall panel relative to the vertical part of the body element to be laid towards the front surface of the wall panel when the hand hold structure is placed to the at least one wall panel in the climbing wall.

13. A hand hold structure as claimed in claim 12, wherein the holder element is arranged at the surface of the vertical part of the hooked construction of the body element facing towards the front surface of the wall panel next to the at least one aperture.

14. A hand hold structure as claimed in claim 13, wherein the holder element is arranged in the body element.

15. A hand hold structure as claimed in claim 13, wherein the holder element is composed of at least one magnet which is embedded into the hand hold element.

* * * * *